US009061299B1

(12) United States Patent
Fodor

(10) Patent No.: US 9,061,299 B1
(45) Date of Patent: Jun. 23, 2015

(54) SPRAY PAINT CAN SPRAYING ACCESSORY

(76) Inventor: Attila P. Fodor, Keasbey, NJ (US)

( * ) Notice: Subject to any disclaimer, the term of this patent is extended or adjusted under 35 U.S.C. 154(b) by 430 days.

(21) Appl. No.: 13/454,184

(22) Filed: Apr. 24, 2012

(51) Int. Cl.

| | |
|---|---|
| ***B05B 1/18*** | (2006.01) |
| ***B05B 1/20*** | (2006.01) |
| ***B05B 9/01*** | (2006.01) |
| ***B05B 13/04*** | (2006.01) |
| ***B05B 13/02*** | (2006.01) |
| ***B65D 83/20*** | (2006.01) |

(52) U.S. Cl.
CPC . *B05B 1/207* (2013.01); *B05B 1/20* (2013.01); *B05B 9/01* (2013.01); *B05B 13/0436* (2013.01); *B05B 13/0207* (2013.01); *B65D 83/203* (2013.01); *B65D 83/205* (2013.01)

(58) Field of Classification Search
CPC ..... B05B 9/01; B05B 1/20; B05B 1/207; B05B 13/0436; B05B 13/0207; B05B 13/0214; B65D 83/203; B65D 83/205; B65D 83/207; B65D 83/24
USPC ..... 239/525–527, 567, 600, DIG. 14; 118/305, 313, 315–315; 222/402.13–402.14, 402.21, 529
See application file for complete search history.

(56) References Cited

U.S. PATENT DOCUMENTS

| | | | | | |
|---|---|---|---|---|---|
| 1,829,831 | A | * | 11/1931 | Hiskey | 118/307 |
| 2,535,451 | A | * | 12/1950 | Phillips | 118/305 |
| 2,881,461 | A | | 4/1959 | Parker | |
| 3,125,298 | A | * | 3/1964 | Iwata | 239/543 |
| 3,305,144 | A | * | 2/1967 | Beres et al. | 222/402.13 |
| 3,322,347 | A | | 5/1967 | Pierce | |
| 3,428,224 | A | * | 2/1969 | Douglas et al. | 222/402.13 |
| 3,567,081 | A | | 3/1971 | Meshberg | |
| 3,650,438 | A | * | 3/1972 | Stephenson et al. | 222/402.22 |
| 3,680,738 | A | * | 8/1972 | Vos et al. | 222/54 |
| 3,756,512 | A | * | 9/1973 | Dyal | 239/337 |
| 3,844,485 | A | | 10/1974 | Waggoner | |
| 4,350,299 | A | * | 9/1982 | Stephenson et al. | 239/337 |
| 4,709,717 | A | * | 12/1987 | Rannigan et al. | 134/199 |
| 4,895,190 | A | * | 1/1990 | Gillen | 141/1 |
| 4,895,280 | A | * | 1/1990 | Tourigny | 222/402.13 |
| 4,928,859 | A | | 5/1990 | Krahn | |
| 4,941,600 | A | * | 7/1990 | Berriochoa et al. | 222/402.13 |
| 5,110,231 | A | * | 5/1992 | Monteith et al. | 401/190 |
| 5,285,968 | A | | 2/1994 | McSheehy | |
| 5,307,964 | A | * | 5/1994 | Toth | 222/402.13 |
| 5,410,773 | A | | 5/1995 | Forkner | |
| 5,924,599 | A | * | 7/1999 | Brown | 222/135 |
| 5,975,435 | A | | 11/1999 | Whited, II | |
| 6,126,044 | A | * | 10/2000 | Smith | 222/402.14 |
| 6,382,469 | B1 | * | 5/2002 | Carter et al. | 222/153.06 |
| 6,455,104 | B1 | | 9/2002 | Kirwan | |
| 6,592,055 | B1 | | 7/2003 | Marino | |
| 2002/0011259 | A1 | * | 1/2002 | Pociask | 134/34 |
| 2006/0060614 | A1 | * | 3/2006 | Garner | 222/402.1 |

* cited by examiner

*Primary Examiner* — Dinh Q Nguyen

(57) ABSTRACT

The spray paint can spraying accessory attaches onto an existing can of spray paint, and which is able to direct paint inwardly around a focal point in order to paint a cylindrical or circular object. The spray paint can accessory includes a nozzle housing that attaches atop of a spray paint can, and a can nozzle that attaches onto the outlet tube of the existing spray paint can. A spray gun hose connects with the can nozzle to direct paint to a spray gun having a plurality of paint nozzles positioned along an assembly, and which direct paint inwardly around a focal point. The assembly and paint nozzles include an opening to enable ingress and egress of the object to be painted. The can nozzle housing includes a threaded member that upon rotation engages the can nozzle downwardly thereby operating the outlet tube of the spray paint can.

4 Claims, 2 Drawing Sheets

SPRAY PAINT CAN SPRAYING ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of spray cans, more specifically, an accessory that attaches onto a spray can, and which provides a sprayer accessory for use therewith.

A traditional spray can features a nozzle that when depressed from above, shall direct a spray of the contents of the can. Sometimes, it is necessary to need additional directional capabilities for use with a spray can. This is especially true, where the object to be painted is cylindrically shaped, like a pipe. In said situation, it may be desirable to direct the paint spray at multiple inward directions in order to spray the circumferential surface of said cylindrical object.

The device of the present application seeks to address the need associated with an accessory that attaches onto a can of spray paint, and which can direct multiple spray nozzles inwardly in order to effectively an efficiently paint a cylindrically shaped object.

B. Discussion of the Prior Art

As will be discussed immediately below, no prior art discloses a spray can spraying accessory that attaches onto an existing spray can, and which includes a plurality of spray nozzles that direct paint inwardly about a focal point in order to spray a cylindrical or round shaped object from all directions simultaneously; wherein the spray paint can spraying accessory includes a can nozzle that attaches onto the outlet tube of the spray can, and which is selectively engaged to operate the outlet tube thereby accessing the spray paint contained within; wherein the can nozzle is in fluid communication with a spray gun that includes a plurality of spray nozzles directed inwardly around said focal point, and which includes an opening to enable a cylindrical or round-shaped object to enter and exit.

The Marino patent (U.S. Pat. No. 6,592,055) discloses a circular spraying device. However, the spraying device is not a device specifically adapted for use with a spray can, and which can selectively paint around a cylindrical or circular object.

The McSheehy patent (U.S. Pat. No. 5,285,968) discloses a C-shaped fluid sprinkler. However, the C-shaped fluid sprinkler is not adapted to directed paint inwardly about a focal point, and in conjunction with a can of spray paint in order to paint a cylindrical or circular object.

The Fairfield et al. patent (U.S. Pat. No. 3,567,081) discloses a multi-directional aerosol dispenser. However, the dispenser is not directed to an assembly that directs paint inwardly about a focal point in order to paint a cylindrical or circular shaped object.

The Waggoner patent (U.S. Pat. No. 3,844,485) discloses a spray apparatus. However, the apparatus does not include an assembly that directs a plurality of spray nozzles inwardly about a focal point in order to paint a cylindrical or circular shaped object, and which attaches to and selectively operates with a spray paint can.

The Krahn et al. patent (U.S. Pat. No. 4,928,859) discloses a quick disconnect for aerosol spray cans. However, the quick disconnect is not a spraying accessory for use with a spray paint can, and which directs spray nozzles inwardly about a focal point in order to paint around a cylinder or circular object.

The Pierce patent (U.S. Pat. No. 3,322,347) discloses a hoop-shaped fluid dispenser. However, the hoop-shaped dispenser is not in fluid communication with a spray paint can, and does not include an opening to enable ingress and egress of a cylinder or circularly shaped object.

The Kirwan patent (U.S. Pat. No. 6,455,104) discloses a paint dispensing device. However, the device is adapted to paint an inner surface of a golf cup, and not around an exterior surface.

The Whited, II patent (U.S. Pat. No. 5,975,435) discloses an adjustable air brush for spray paint cans. However, the air brush does not include an assembly that directs spray paint inwardly about a focal point in order to paint an exterior surface of a cylinder or circular object.

The Forkner patent (U.S. Pat. No. 5,410,773) discloses a pipe paint roller. However, the pipe paint roller is not in fluid communication with a can of spray paint, and also does not include an assembly of spray nozzles that direct paint inwardly about a focal point.

While the above-described devices fulfill their respective and particular objects and requirements, they do not describe a spray can spraying accessory that attaches onto an existing spray can, and which includes a plurality of spray nozzles that direct paint inwardly about a focal point in order to spray a cylindrical or round shape object from all directions simultaneously; wherein the spray paint can spraying accessory includes a can nozzle that attaches onto the outlet tube of the spray can, and which is selectively engaged to operate the outlet tube thereby accessing the spray paint contained within; wherein the can nozzle is in fluid communication with a spray gun that includes a plurality of spray nozzles directed inwardly around said focal point, and which includes an opening to enable a cylindrical or round-shaped object to enter and exit. In this regard, the spray paint can spraying accessory departs from the conventional concepts and designs of the prior art.

SUMMARY OF THE INVENTION

The spray paint can spraying accessory attaches onto an existing can of spray paint, and which is able to direct paint inwardly around a focal point in order to paint a cylindrical or circular object. The spray paint can accessory includes a nozzle housing that attaches atop of a spray paint can, and a can nozzle that attaches onto the outlet tube of the existing spray paint can. A spray gun hose connects with the can nozzle to direct paint to a spray gun having a plurality of paint nozzles positioned along an assembly, and which direct paint inwardly around a focal point. The assembly and paint nozzles include an opening to enable ingress and egress of the object to be painted. The can nozzle housing includes a threaded member that upon rotation engages the can nozzle downwardly thereby operating the outlet tube of the spray paint can.

An object of the invention is to provide an accessory that attaches onto an existing can of spray paint, and which includes an assembly of paint nozzles that direct spray paint inwardly about a focal point so as to paint an exterior surface of a cylinder or circular object.

Another object of the invention is to provide a spraying accessory that attaches onto a top of a can of spray paint, and which includes a can nozzle that connects onto an outlet tube of said spray paint can.

An even further object of the invention is to include a threaded member that rotates to push the can nozzle downwardly in order to selectively operate the outlet tube of the spray paint can.

Another object of the invention is to provide a spray gun that includes a trigger that selectively enables paint to travel from the spray paint can to the paint nozzles located along the assembly, as a second valve that works independently of the can nozzle.

Another object of the invention is to include an assembly that includes an opening for ingress and egress of the object to be painted.

Another object of the invention is to provide a spraying accessory that can be installed and removed from a can of spray paint, and which can be cleaned, and re-used.

These together with additional objects, features and advantages of the spray paint can spraying accessory will be readily apparent to those of ordinary skill in the art upon reading the following detailed description of presently preferred, but nonetheless illustrative, embodiments of the spray paint can spraying accessory when taken in conjunction with the accompanying drawings.

In this respect, before explaining the current embodiments of the spray paint can spraying accessory in detail, it is to be understood that the spray paint can spraying accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the spray paint can spraying accessory.

It is therefore important that the claims be regarded as including such equivalent construction insofar as they do not depart from the spirit and scope of the spray paint can spraying accessory. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
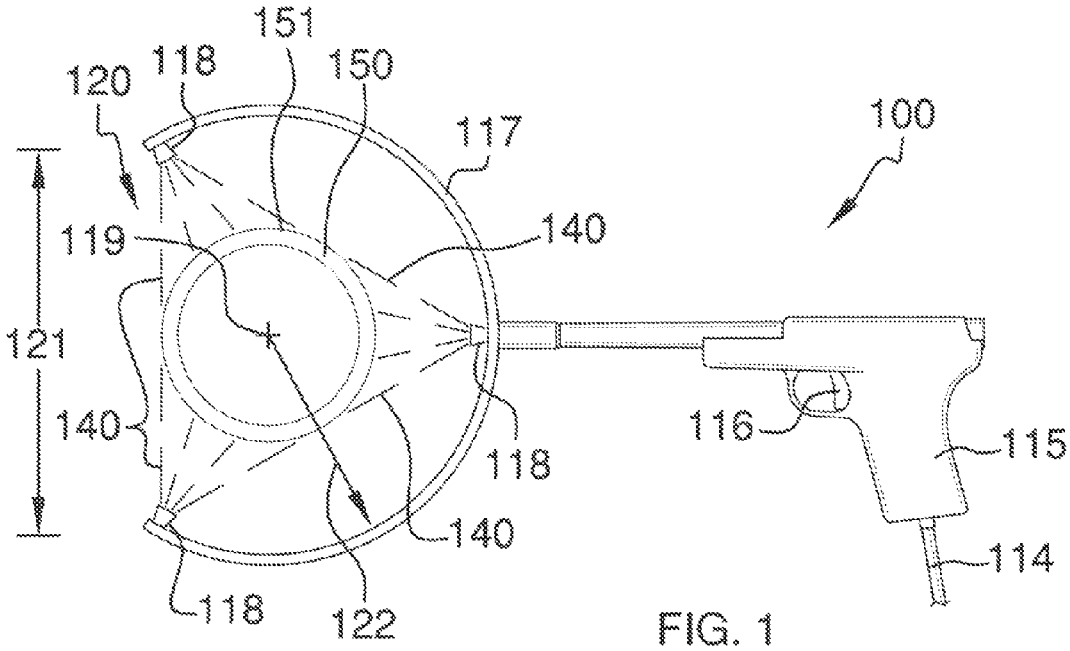
FIG. 1 illustrates a view of the spray gun and spray nozzle assembly directing paint spray about a focal point and onto an outer surface of a cylindrical object located therein.
Figure 2:
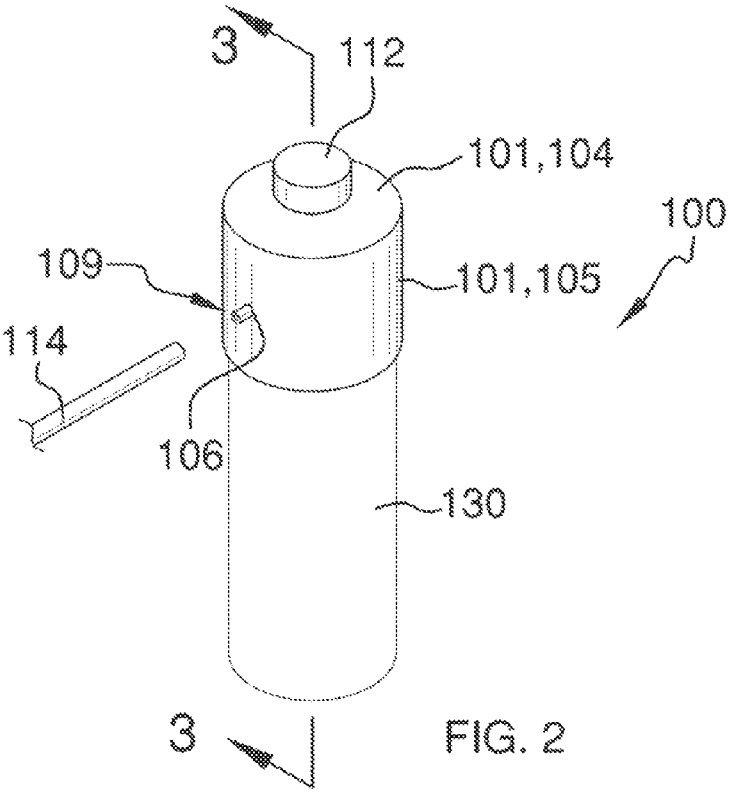
FIG. 2 illustrates a view of the can nozzle housing attached onto an existing spray paint can, and a spray gun hose aligned adjacent therewith.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-4. A spray paint can spraying accessory 100 (hereinafter invention) includes a nozzle housing 101 that attaches onto an existing spray paint can 130. The nozzle housing 101 is a cylindrically shaped object that forms an interior cavity 102 with a top surface 131 of the spray paint can 130. The nozzle housing 101 includes a grooved member 103, which engages an annular ring 132 of the spray paint can 130 thereby attaching the nozzle housing 101 onto the spray paint can 130.

Figure 4:
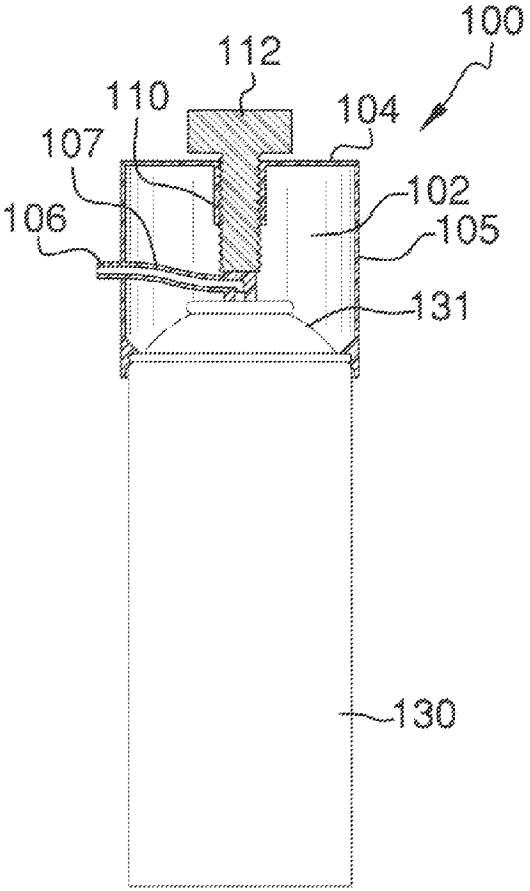
FIG. 4 illustrates a cross-sectional view of the spray paint can spraying accessory along line 3-3 in FIG. 2, and detailing the can nozzle pushed down onto the outlet tube of the spray can via the threaded member engaged with respect to the nozzle housing, and which details use of the spraying accessory with the existing can of spray paint.
Figure 3:
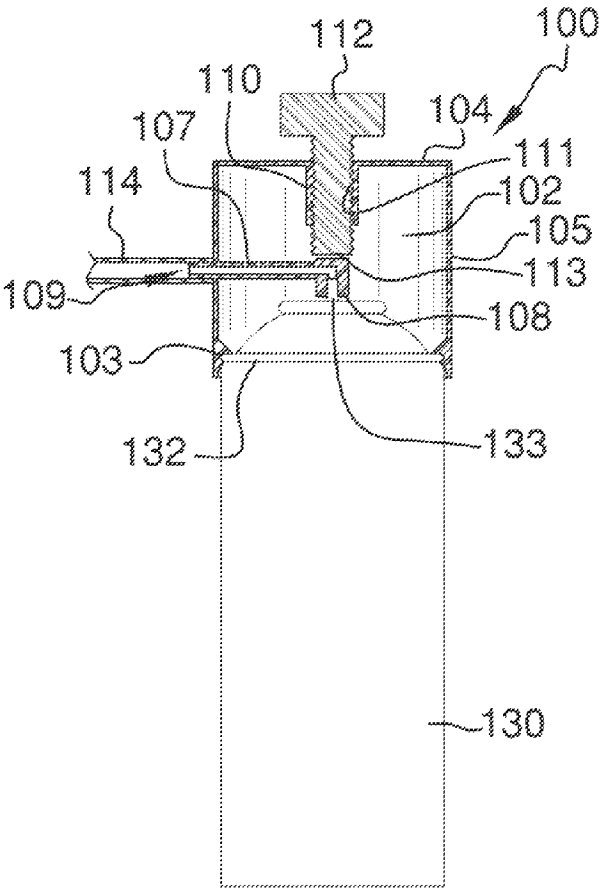
FIG. 3 illustrates a cross-sectional view of the spray paint can spraying accessory along line 3-3 in FIG. 2, and detailing the can nozzle secured onto the outlet tube of the spray paint can, and further detailing fluid communication with the spray gun hose.

The nozzle housing 101 is further defined with a top surface 104 and a circular, side surface 105. Referring to FIGS. 3 and 4, the circular, side surface 105 includes an opening 106 through which a can nozzle 107 extends. The can nozzle 107 is constructed of a flexible tube that has an elbow shape defining an inlet 108 and an outlet 109. The inlet 108 of the can nozzle 107 attaches onto an outlet tube 133 of the spray paint can 130. Upon depression of the can nozzle 107 (see FIGS. 3-4), the outlet tube 133 of the spray paint can 130 descends with respect to the spray paint can 130, thereby enabling paint 140 to escape therefrom, and travel through the can nozzle 107.

The top surface 104 of the nozzle housing 101 includes a threaded collar 110 having internal threadings 111 within which a threaded member 112 screws into. The threaded member 112 rotates with respect to the nozzle housing 101, and either extends up or down with respect to the nozzle housing 101. The threaded member 112 includes a bottom surface 113 that engages the can nozzle 107 from above. Upon downward rotation of the threaded member 112, the bottom surface 113 shall push both the can nozzle 107 and the outlet tube 133 down with respect to the spray paint can 130, and thereby accessing the paint 140 contained therein.

The outlet 109 of the can nozzle 107 attaches to a spray gun hose 114, which is of an undefined length, and is in fluid communication between the can nozzle 107 and a spray gun 115. The spray gun 115 includes a trigger 116, which is a valve that controls the output of paint 140 with respect to the spray gun 115. The spray gun 115 is attached to an assembly 117 having a curvature of an undefined radius 122.

The assembly 117 includes a plurality of spray nozzles 118 arranged in intervals thereon. The spray nozzles 118 are aimed and direct the paint 140 inwardly about a focal point 119. It shall be noted that the assembly 117 and the spray nozzles 118 are the chief objective of the invention 100, and that the paint 140 is directed inwardly in an atomized spray about the focal point 119 in order to paint an outer surface of an object 150 located therein. It shall be further noted that the assembly 117 includes an opening 120 of an undefined length 121 with which to provide ingress and egress of the object 150. Furthermore, it shall be noted that the term object 150 is being used to describe a cylindrical or circular object with which an outer surface 151 is painted via the invention 100.

It should be noted that the figures depict only 3 spray nozzles 118 thereon. However, it should be noted that more spray nozzles 118 may be included, and may be needed as the size of the assembly 117 increases. It shall be further noted that the assembly 117 provides fluid communication between the spray gun 115 and the spray nozzles 118. Moreover, the assembly 117 equally distributes the paint 140 to all of the spray nozzles 118. The assembly 117 may have a different shape than that being depicted in order to provide different area coverage therein. In other words, the assembly 117 may have an oblong shape, or an oval shape, etc.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A spray paint can spraying accessory comprising:

a spray gun and assembly that includes a plurality of spray nozzles directed inwardly to a focal point in order to paint an outer surface of a circular or cylindrical object;

wherein the spray gun is connected to a spray paint can;

wherein a can nozzle is in fluid communication between said spray gun and an outlet tube of said spray paint can;

wherein the can nozzle is a flexible tube having an elbow shape defining an inlet that secures to the outlet tube of the spray paint can;

wherein a nozzle housing supports the can nozzle, and attaches onto a top surface of said spray paint can;

wherein the nozzle housing is further defined with a top surface and a circular, side surface; wherein the circular, side surface includes an opening through which the can nozzle extends; wherein the nozzle housing is a cylindrically shaped object forming an interior cavity with said top surface of the spray paint can; wherein the nozzle housing includes a grooved member that engages an annular ring of the spray paint can;

wherein the top surface of the nozzle housing includes a threaded collar with internal threadings within which a threaded member screws into; wherein the threaded member rotates to extend up or down with respect to the nozzle housing; wherein the threaded member includes a bottom surface that engages the can nozzle from above; whereupon rotation of the threaded collar downwardly until the bottom surface pushes the can nozzle and output tube downwardly with respect to the spray paint can, paint stored within exits through the can nozzle;

wherein the outlet of the can nozzle attaches to a spray gun hose, which is of an undefined length, and is in fluid communication between the can nozzle and said spray gun;

wherein the spray gun includes a trigger, which controls the output of paint with respect to the spray gun.

2. The spray paint can spraying accessory as described in claim 1 wherein the assembly includes an opening of an undefined length with which to provide ingress and egress of the circular or cylindrical object.

3. The spray paint can spraying accessory as described in claim 1 wherein the assembly provides fluid communication between the spray gun and the spray nozzles; wherein the assembly supports the spray nozzles in order to direct paint in an atomized spray inwardly towards said focal point.

4. A spray paint can spraying accessory comprising:

a spray gun and assembly that includes a plurality of spray nozzles directed inwardly to a focal point in order to paint an outer surface of a circular or cylindrical object;

wherein the spray gun is connected to a spray paint can;

wherein a can nozzle is in fluid communication between said spray gun and an outlet tube of said spray paint can;

wherein the can nozzle is a flexible tube having an elbow shape defining an inlet that secures to the outlet tube of the spray paint can;

wherein a nozzle housing supports the can nozzle, and attaches onto a top surface of said spray paint can;

wherein the nozzle housing is further defined with a top surface and a circular, side surface; wherein the circular, side surface includes an opening through which the can nozzle extends; wherein the nozzle housing is a cylindrically shaped object forming an interior cavity with said top surface of the spray paint can; wherein the nozzle housing includes a grooved member that engages an annular ring of the spray paint can;

wherein the top surface of the nozzle housing includes a threaded collar with internal threadings within which a threaded member screws into; wherein the threaded member rotates to extend up or down with respect to the nozzle housing; wherein the threaded member includes a bottom surface that engages the can nozzle from above; whereupon rotation of the threaded collar downwardly until the bottom surface pushes the can nozzle and output tube downwardly with respect to the spray paint can, paint stored within exits through the can nozzle;

wherein the outlet of the can nozzle attaches to a spray gun hose, which is of an undefined length, and is in fluid communication between the can nozzle and said spray gun;

wherein the spray gun includes a trigger, which controls the output of paint with respect to the spray gun;

wherein the assembly includes an opening of an undefined length with which to provide ingress and egress of the circular or cylindrical object;

wherein the assembly provides fluid communication between the spray gun and the spray nozzles; wherein the assembly supports the spray nozzles in order to direct paint in an atomized spray inwardly towards said focal point.

* * * * *